United States Patent [19]

Schmidger

[11] 4,037,900

[45] July 26, 1977

[54] BASEBOARD FOR ELECTRICAL INSTALLATIONS

[76] Inventor: Fritz Schmidger, Loomatt Atrium 4, Stallikon, Zurich, Switzerland

[21] Appl. No.: 457,696

[22] Filed: Apr. 4, 1974

[30] Foreign Application Priority Data

Apr. 13, 1973 Switzerland ..... 5316/73

[51] Int. Cl.[2] ..... H01R 7/28

[52] U.S. Cl. ..... 339/23; 52/717; 174/48; 339/22 R

[58] Field of Search ..... 339/20, 21 R, 22 R, 339/23, 24; 174/48, 49; 52/242, 717, 718

[56] References Cited

U.S. PATENT DOCUMENTS

| | | | |
|---|---|---|---|
| 1,981,239 | 11/1934 | Manske | 52/242 |
| 2,203,119 | 6/1940 | Wollaeger | 52/717 |
| 2,478,006 | 8/1949 | Paden | 339/21 R |
| 3,256,668 | 6/1966 | Downes | 52/242 |
| 3,683,312 | 8/1972 | Routh | 339/21 R |

FOREIGN PATENT DOCUMENTS

| | | | |
|---|---|---|---|
| 2,002,419 | 9/1970 | Germany | 339/21 R |
| 435,396 | 10/1967 | Switzerland | 174/48 |

*Primary Examiner*—Roy Lake
*Assistant Examiner*—Mark S. Bicks
*Attorney, Agent, or Firm*—Anthony J. Casella; Joseph Calvaruso

[57] ABSTRACT

A baseboard for electrical installation includes a shaped cover part which is fastened to a wall by holding means, and is provided with longitudinally extending bare wires which may be readily connected to adapters to form electrical switch apparatus or electrical distributing elements in the baseboard.

4 Claims, 11 Drawing Figures

Figure 5:
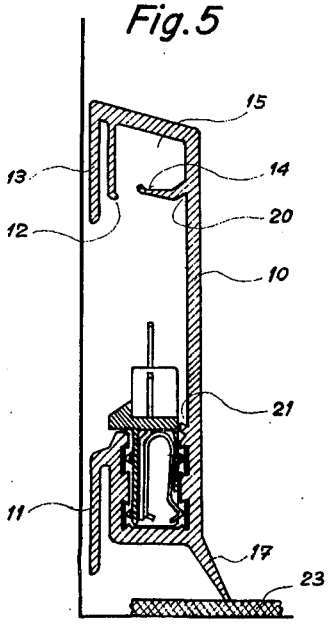

Fig. 1
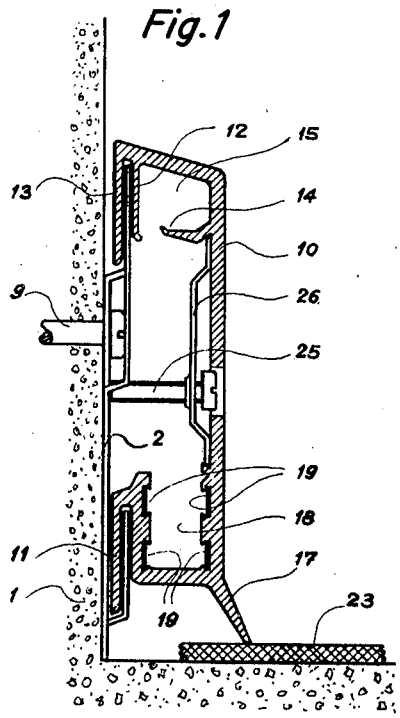
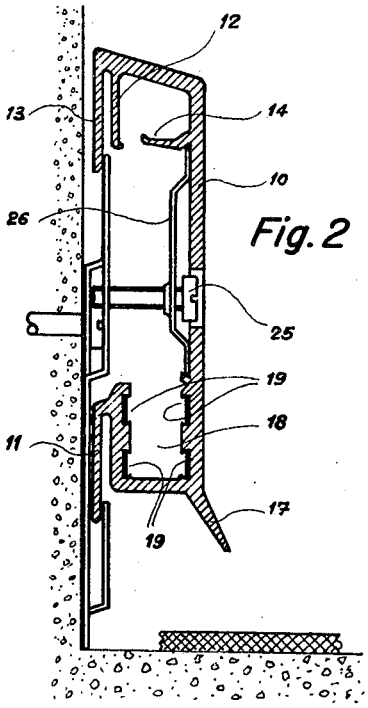
Fig. 2
Fig. 3
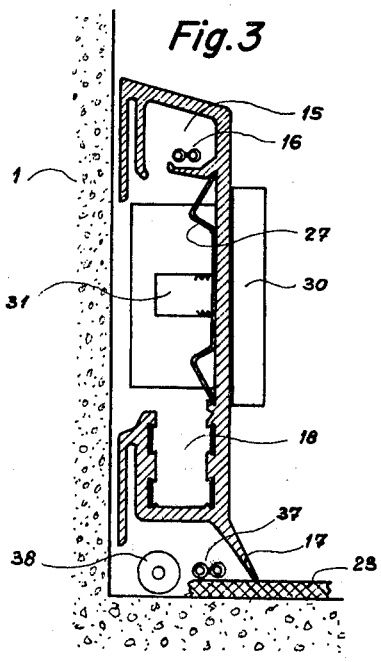
Fig. 4
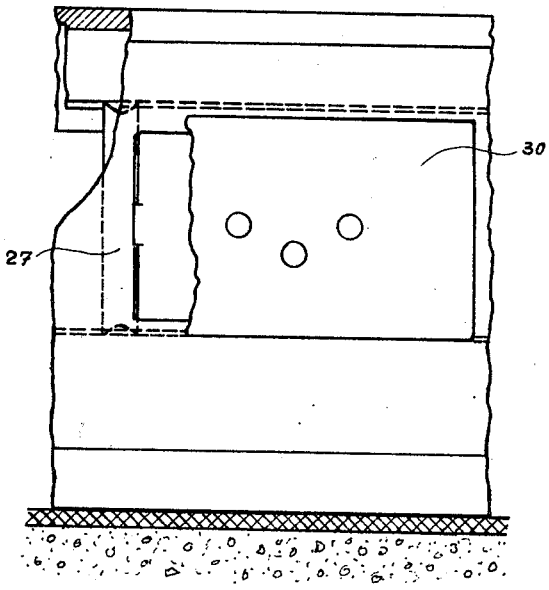

BASEBOARD FOR ELECTRICAL INSTALLATIONS

The present invention relates to a baseboard for electrical installations, having holding means which are adapted to be fastened to a wall and a shaped cover part which is adapted to be mounted on said holding means.

Baseboards of this type are known in which a shaped supporting part adapted to be fastened to a wall by screws and provided with ducts for the insertion of the electric lines is provided, onto which a shaped cover part can be plugged or otherwise fastened. The distributing and switch apparatus to be connected to the lines, such as outlets of all types, switches or the like, are adapted to be arranged outside the baseboard and cannot be arranged directly on the shaped cover part. Such a system is not only expensive to manufacture as a result of the necessary presence of two continuous shaped sections, but it also requires a time-consuming amount of installation work. Prefabrication of the installation is out of the question for all practical purposes.

It has also been proposed to place a shaped covering part of flexible plastic directly on screws screwed into the wall. For this purpose the shaped covering part is so developed in cross section that the heads of the fastening screws are elastically surrounded. When such a baseboard is used, wires or cables can be placed in the space between the wall and the hollow shaped covering part is put on. To be sure, such an installation is rather difficult since the wires or cables are held only after the shaped covering part is placed on. Furthermore, the wires or cables drop out again if the shaped covering part is subsequently removed in order to clean the floor or effect repairs or the like.

The object of the present invention is to eliminate these drawbacks. In particular there is to be provided a compact baseboard which is relatively cheap to manufacture, can be installed easily and rapidly and can be used as a basic element for an integrated electrical installation system which has possibly been prefabricated.

This object is achieved in accordance with the invention in the manner that the shaped cover part is equipped with longitudinally extending electric wires arranged thereon and/or has at least one open longitudinal duct into which electric wires can be introduced in the uninstalled condition of the shaped cover part and which holds the wires introduced therein firmly in position during and after the installing of the shaped cover part.

The invention is therefore based on the idea of using the shaped cover part itself as support for the electric lines of all types. In this connection the wires can either be firmly connected with the shaped cover part and form a portion thereof or one or more ducts can be provided in the shaped cover part and wires or cables introduced into them before or during the course of the actual installation work. The two possibilities can also be combined with each other.

In order to provide an installation system which is as fully integrated as possible, it is advisable to equip the shaped covering part with a flat portion which has no duct or electrical wires lying directly opposite it. Electrical switch apparatus or distributing elements which are accessible from the outside can be fastened directly to said flat portion. The insertion of the outlets, switches, etc., as well as the connecting of them to the wires contained in the shaped cover part can frequently be effected while at the factory, as a result of which the installation work at the place of use is reduced to a minimum.

Electric wires or ducts to receive such wires are, to particular advantage, provided in the shaped cover part below and above the flat region intended for the application of electrical switch apparatus or distributing elements. This utilization of the space has the particular advantage that it is possible to arrange, for instance, electric power outlets and telephone jacks on the same cover board and connect them without the different types of wires crossing each other.

One preferred embodiment of the subject matter of the invention will be described below by way of example with reference to the accompanying drawings. There is concerned here a plastic baseboard whose shaped cover part is provided on its back with an open duct which receives several partially embedded bare wires. These wires can be connected to outlets, switches, etc., by means of adapters introduced into the duct, the outlets, etc., and fastened to the shaped cover part at the factory or at the place of installation.

Figure 7:
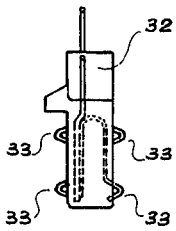
Figure 6:
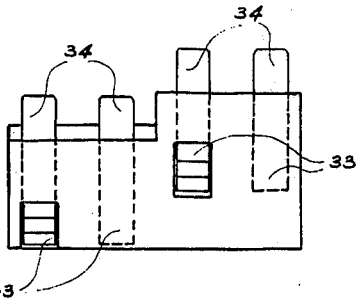
Figure 8:
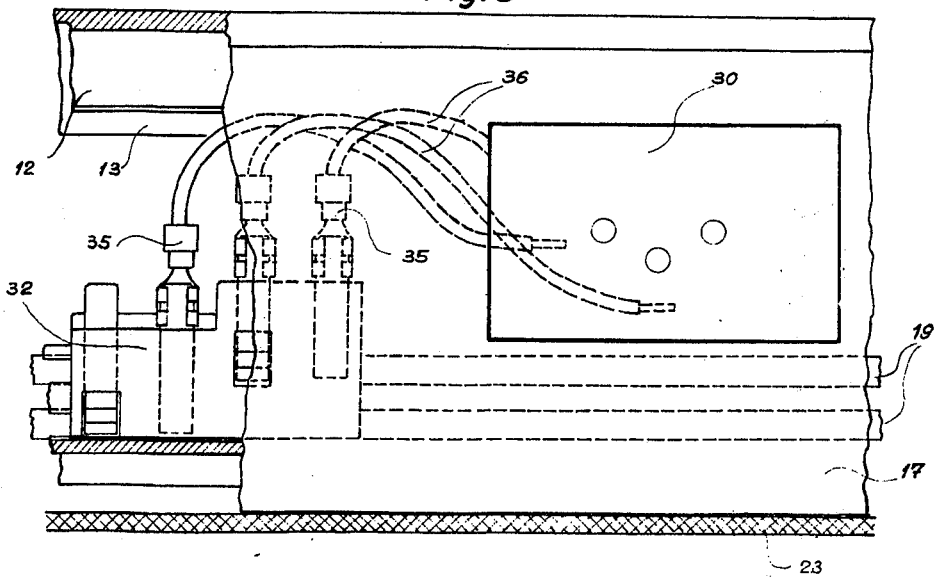
Figure 9:
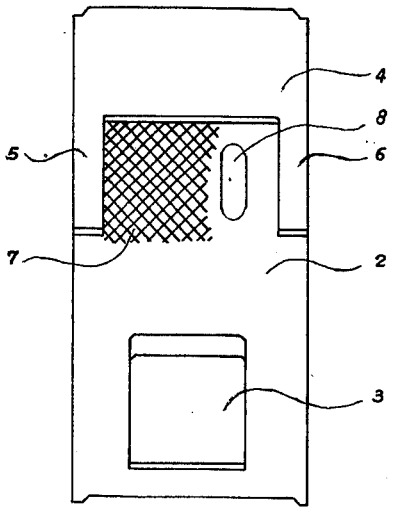
Figure 10:
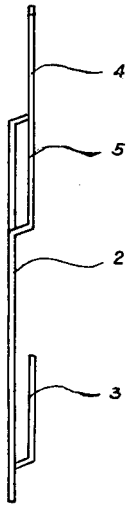
Figure 11:
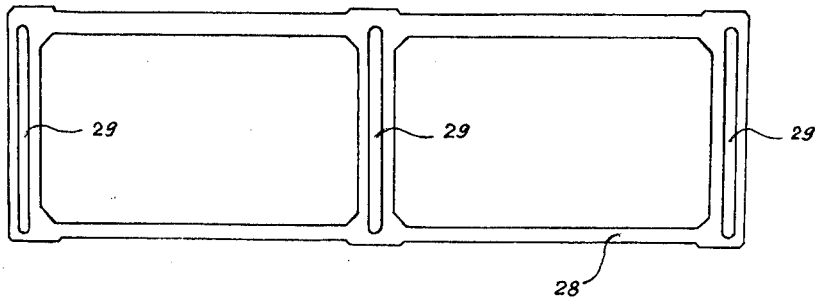

In the drawings:

FIG. 1 is a section through the completely mounted baseboard, in a direction perpendicular to the longitudinal direction of the cover board, FIG. 2 is a section similar to FIG. 1 with the cover board raised, FIG. 3 is a section taken at a different place, FIG. 4 is a front view of the baseboard, partially broken away, FIG. 5 is another sectional view with adapter introduced into the wire duct, FIG. 6 is a front view of an adapter, FIG. 7 is a side view of the adapter of FIG. 6, FIG. 8 is a front view of the baseboard, partially broken away, at a place different from the view in FIG. 4, FIG. 9 is a front view of a support for the fastening of the shaped cover part, FIG. 10 is a side view of the support of FIG. 9, and FIG. 11 is a view of a small metal frame for the installing of outlets or switches.

The shaped plastic cover part 10 which is described in further detail below is held by relatively flat supports 2 which are preferably spaced an equal distance apart and fastened to a wall 1. These supports can be stamped from sheet iron and be protected from rusting by a zinc coating. In the lower and upper regions, tabs 3 and 4 for the suspending of the shaped cover part 10 are passed out. The tab 4 which extends over the entire width is continued laterally downward in the form of two side parts 5 and 6 which act as stops. It can be noted in particular from FIGS. 9 and 10 that the supports can be made in a single operation from a flat metal sheet. In the region marked 7 the support has a rough surface, for instance a scratched surface. A slot 8 serves for the passage of a screw 9 which is screwed directly into the wall 1 or into a peg. As long as this screw is not tightened, the support can be adjusted in height within the region limited by the length of the slot 8.

The shaped cover part 10 is best produced by extrusion of a thermoplastic resin. A plurality of longitudinally extending lips 11, 12 and 13 permit the shaped cover part 10 to be hung from the tabs 3 and 4. Another thin, elastic lip 14 substantially closes off a longitudinal duct intended to receive telephone wires 16. Finally, a longitudinally extending lip 17 extends down to the floor covering 23 when the shaped cover part is in its mounted and lowered position.

On its lower side, the cross section of the shaped part is such that a U-shaped duct 18 open on top and accessible from the rear of the shaped cover part is produced, in the walls of which four bare wires 19 with in part bared surfaces are embedded. These wires are advantageously combined with the plastic material during the course of the production of the shaped part.

Two longitudinal grooves 20 and 21 on the inside of the shaped cover part 2 can be noted in particular in FIG. 5. Into these facing grooves there can be inserted holding elements, for instance straps 26 bearing fastening screws (FIGS. 1 and 2), bent holding springs 27 with pointed ends (FIGS. 3 and 4) or small metal installation frames 28 provided with one or more openings and reinforced in the region of their transverse arm by impressed ribs 29 (FIG. 11).

As long as the screws 25 distributed over the length of the shaped cover part 10 are loose, it is possible to displace this shaped part horizontally within the limits determined by the stops 5 and 6, and furthermore vertically. The vertical adjustability permits subsequent adaptation of the position of the shaped covering part to the thickness of the final floor covering (linoleum, carpeting).

Upon the tightening of the screws 25, their face ends come against the rough surface 7. An interlock then takes place between the holding elements 2 and the shaped covering part 10. In the raised position shown in FIG. 2, the shaped covering part 10 in no way interferes with the worker in charge of the laying of the floor covering. Due to the adjustability described, cleaning and repair work, for instance, are also facilitated. In FIG. 1 the shaped covering part 10 is shown in its lowered position in which the lower edge of the tongue 17 contacts the floor covering 23. The screws 25 are tightened in this position of the shaped covering part, whereby unintended shifting of the part 10 is made impossible.

The distributing elements and/or switch apparatus to be connected to the electric wires enclosed by the shaped covering part are preferably inserted into corresponding openings in the shaped covering part 10. These openings can be produced, in accordance with the requirements of the electrician, by means of a special tool at the place of installation. Prefabrication processess are, however, also suitable. In the example shown, an outlet 30 is inserted countersunk in the shaped covering part 10. It can be provided on both sides with serrated lock springs 31 which lock against the side edges of the holding springs 27.

The single or multiple small holding frames 28 shown in principle in FIG. 11, which, after insertion into the grooves 20 and 21, can be locked by fastening means not shown in the drawings, are in certain cases preferable to the springs 27, since they hold the distributing elements and switch apparatus fast more effectively and produce a better reinforcement of the shaped covering part.

In the example shown in the drawing it is assumed that a wire 19 is connected directly to one phase of a current distribution network. Another wire 19 is a switched phase and accordingly makes it possible, for instance, to connect a lamp which can be turned on and off from this remote point. The remaining wires 19 are a neutral wire and a ground wire. For the connecting of the outlets 30, switches or the like to the bare wires 19, adapters consisting of an insulating body 32 and of contact springs 33 held by same are provided which can be introduced, with the shaped covering part 10 off, into the duct 18, whereby the contact springs 33 automatically come against the wires 19. The upper ends 34 of the springs 33 are connected via pressed-on terminals 35 and pieces of insulated wire 36 extending away from same to the connecting terminals of the connected apparatus.

The connecting system with adapter affords the electrician the possibility of connecting by only a few manipulations outlets or other distributing elements, as well as switches, which form a part of the baseboard. The connections from the adapters to the parts and apparatus to be fed can be prefabricated, whereby the time required for installation is further descreased.

The hollow space which is normally covered and protected by the lip 17 can be used for the loose insertion of a bell wire 37, a television antenna line 38 and possibly to receive other or additional cables or wires.

Finally, the shaped cover part could also be provided on its rear with longitudinal channels in which bare wires or plastic strips with partially embedded bare wires can be inserted in longitudinal direction from the free end of the shaped part.

The embodiments of the invention, in which an exclusive property or privilege is claimed, are defined as follows:

1. Baseboard for electrical installation comprising:

an elongated hollow cover board made of a plastic material and having a front side and a rear side, said rear side including a longitudinally extending insulating material portion, said cover board including: (1) a longitudinally extending flat section on the front side of said cover board for mounting electrical distributing apparatus so that the latter are accessible from the outside of the cover board; (2) longitudinally running bare wires partly embedded in the insulating material portion on the rear and normally concealed side of the cover board, outside the region of said flat mounting section; and (3) holding means on the rear side of the cover board, in the region of said bare wires for the removable application of adapters connected to said electrical distributing apparatus and provided with bare contacts for connecting said apparatus to the bare wires; and fastening means for securing said cover board to a wall, said fastening means consisting of fastening screws and a plurality of metallic supports, each of which is provided with upwardly directed tabs for suspending the cover board, and furthermore with lateral stops limiting an area having a rough surface against which, in the completely installed condition, the free end of the fastening screw borne by the cover board rests.

2. Baseboard according to claim 1 wherein said holding means comprise a longitudinal duct (18) into which adapters may be inserted by a transversal movement and in which the bare wires are in such a way partly embedded that a bare surface of each wire is directed towards the inside of the duct.

3. Baseboard according to claim 1 wherein the cover board (10) is provided on its rear but outside the region of the flat mounting section with a slotted longitudinal duct (15) for the transversal insertion of electrical wires.

4. Baseboard according to claim 3, wherein the duct (18) housing the bare wires (19) is arranged on one side and the slotted duct (15) on the other side of the flat section provided for mounting electrical distributing apparatus.

* * * * *